US009159525B2

(12) United States Patent
Yamazaki et al.

(10) Patent No.: US 9,159,525 B2
(45) Date of Patent: Oct. 13, 2015

(54) RADIATION GENERATING TUBE

(75) Inventors: Koji Yamazaki, Ayase (JP); Kazuyuki Ueda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 698 days.

(21) Appl. No.: 13/476,209

(22) Filed: May 21, 2012

(65) Prior Publication Data

US 2012/0307978 A1 Dec. 6, 2012

(30) Foreign Application Priority Data

Jun. 1, 2011 (JP) ..... 2011-123459

(51) Int. Cl.

*H01J 35/16* (2006.01)
*H01J 35/06* (2006.01)
*H01J 35/18* (2006.01)

(52) U.S. Cl.

CPC ..... *H01J 35/16* (2013.01); *H01J 35/06* (2013.01); *H01J 35/18* (2013.01); *H01J 2235/087* (2013.01); *H01J 2235/168* (2013.01); *H01J 2235/186* (2013.01)

(58) Field of Classification Search

CPC ..... H01J 2235/087; H01J 2235/168; H01J 2235/186; H01J 35/06; H01J 35/16; H01J 35/18

USPC ..... 378/121, 136; 174/84

See application file for complete search history.

(56) References Cited

U.S. PATENT DOCUMENTS

| | | | | | |
|---|---|---|---|---|---|
| 3,764,838 | A | * | 10/1973 | Charpentier | 313/360.1 |
| RE35,383 | E | * | 11/1996 | Miller et al. | 378/138 |
| 5,637,957 | A | * | 6/1997 | Konishi et al. | 313/495 |
| 6,044,130 | A | | 3/2000 | Inazura et al. | 378/138 |
| 6,148,061 | A | * | 11/2000 | Shefer et al. | 378/121 |
| 7,236,569 | B2 | | 6/2007 | Takeuchi et al. | 378/139 |

(Continued)

FOREIGN PATENT DOCUMENTS

| | | | |
|---|---|---|---|
| JP | S58-106745 | | 6/1983 |
| JP | 04255642 | A * | 9/1992 |

(Continued)

OTHER PUBLICATIONS

Shannon et al., Insulation of High Voltage Across Solid Insulators in Vacuum, 1965, Journal of Vacuum Science and Technology, vol. 2, pp. 234-239.*

(Continued)

*Primary Examiner* — David J Makiya
*Assistant Examiner* — John Corbett
(74) *Attorney, Agent, or Firm* — Fitzpatrick, Cella, Harper & Scinto

(57) ABSTRACT

The present invention provides a radiation generating tube which suppresses electrical charging of an inner wall of an insulating tube attributable to electron emission from a junction between the insulating tube and a cathode and which has improved voltage withstand capability. The radiation generating tube comprising: a hollow insulating tube; a cathode and an anode respectively bonded to both ends of the insulating tube; and an electron emission source provided on the cathode, the radiation generating tube having a vacuum interior space. The electron emission source includes an electron emitting portion in the interior space, and the insulating tube includes a protrusion that protrudes into the interior space.

11 Claims, 6 Drawing Sheets

(56) References Cited

U.S. PATENT DOCUMENTS

| | | | | |
|---|---|---|---|---|
| 2003/0021377 | A1* | 1/2003 | Turner et al. | 378/102 |
| 2007/0076849 | A1 | 4/2007 | Bard et al. | 378/121 |
| 2011/0235783 | A1 | 9/2011 | Ogura et al. | 378/112 |
| 2012/0121069 | A1 | 5/2012 | Aoki et al. | 378/98.8 |

FOREIGN PATENT DOCUMENTS

| | | |
|---|---|---|
| JP | 09-180660 | 7/1997 |
| JP | 2006-019223 | 1/2006 |
| JP | 2009-021032 | 1/2009 |
| JP | 2009-245806 | 10/2009 |
| JP | 2010-009977 | 1/2010 |

OTHER PUBLICATIONS

Yamamoto et al., Numerical Design of High Voltage Insulator Structure Considering SEEA Charge Accumulation in Vacuum, 1996, IEEE, XVIIth Int. Sym. on Discharges and Electrical Insulation in Vacuum, pp. 502-506.*

JPO Office Action issued on Feb. 10, 2015, in counterpart Japanese patent application 2011-123459, with translation.

* cited by examiner

RADIATION GENERATING TUBE

BACKGROUND OF THE INVENTION

1. Field of the Invention

The present invention relates to a radiation generating tube which uses a transmissive target and is applicable to a radiation generating apparatus.

2. Description of the Related Art

A transmissive radiation generating tube generates radiation by accelerating electrons emitted from an electron emission source of a cathode with a high voltage applied between an anode and the cathode and irradiating a metallic target provided at the anode with the accelerated electrons, and is adopted in medical and industrial radiation generating apparatuses.

With such a radiation generating tube, voltage withstand capability have been an issue that makes downsizing and weight reduction difficult. Japanese Patent Application Laid-open No. H09-180660 discloses improving voltage withstand capability of a transmissive radiation generating tube by using a structure in which a focusing electrode of an electron gun is sandwiched between and fixed by an insulating tube and a cathode and in which a gap is provided between a tube wall and the focusing electrode in order to increase an insulation creepage distance of the tube wall. In addition, Japanese Patent Application Laid-open No. 2006-019223 discloses a reflective radiation generating tube in which irregularities with an arithmetic-mean roughness of 1 to 10 μm are formed on a vacuum-side surface of a glass insulator that supports a conductor in a vacuum chamber over a certain range from an end position of the conductor.

The following problem arises when attempting to achieve higher voltage or further downsizing of a radiation generating tube.

With a radiation generating tube in which a cathode is bonded to an end edge of an insulating tube, there is a structural risk that unintended electron emission may occur from a junction (bonded interface) between the insulating tube and the cathode. When increasing voltage or reducing a size of the radiation generating tube, electrons emitted from the junction may increase due to an increase in field intensity in a vicinity of the junction. Such emitted electrodes may electrically charge an inner wall of the insulating tube and may potentially cause a discharge.

SUMMARY OF THE INVENTION

The present invention has been made in consideration of the problem described above, and an object thereof is to provide a radiation generating tube which suppresses electrical charging of an inner wall of an insulating tube attributable to electron emission from a junction between the insulating tube and a cathode and which has improved voltage withstand capability.

The present invention provides a radiation generating tube including: a hollow insulating tube; a cathode and an anode respectively bonded to both ends of the insulating tube; and an electron emission source provided on the cathode, the radiation generating tube having a vacuum interior space that is enclosed by the insulating tube, the cathode, and the anode, wherein the electron emission source includes an electron emitting portion in the interior space, and the insulating tube includes a protrusion that protrudes into the interior space.

According to the present invention, a radiation generating tube can be provided which suppresses electrical charging of an inner wall of an insulating tube attributable to electron emission from a junction between the insulating tube and a cathode and which has improved voltage withstand capability.

Further features of the present invention will become apparent from the following description of exemplary embodiments with reference to the attached drawings.

DESCRIPTION OF THE EMBODIMENTS

Hereinafter, a preferred embodiment of a radiation generating tube according to the present invention will be exemplarily described in detail with reference to the accompanying drawings. However, unless stated otherwise, materials, dimensions, shapes, relative arrangements, and the like of components described in the present embodiment are not intended to limit the scope of the present invention.

In addition, X-rays are assumed as the radiation used in the present embodiment.

Figure 1:
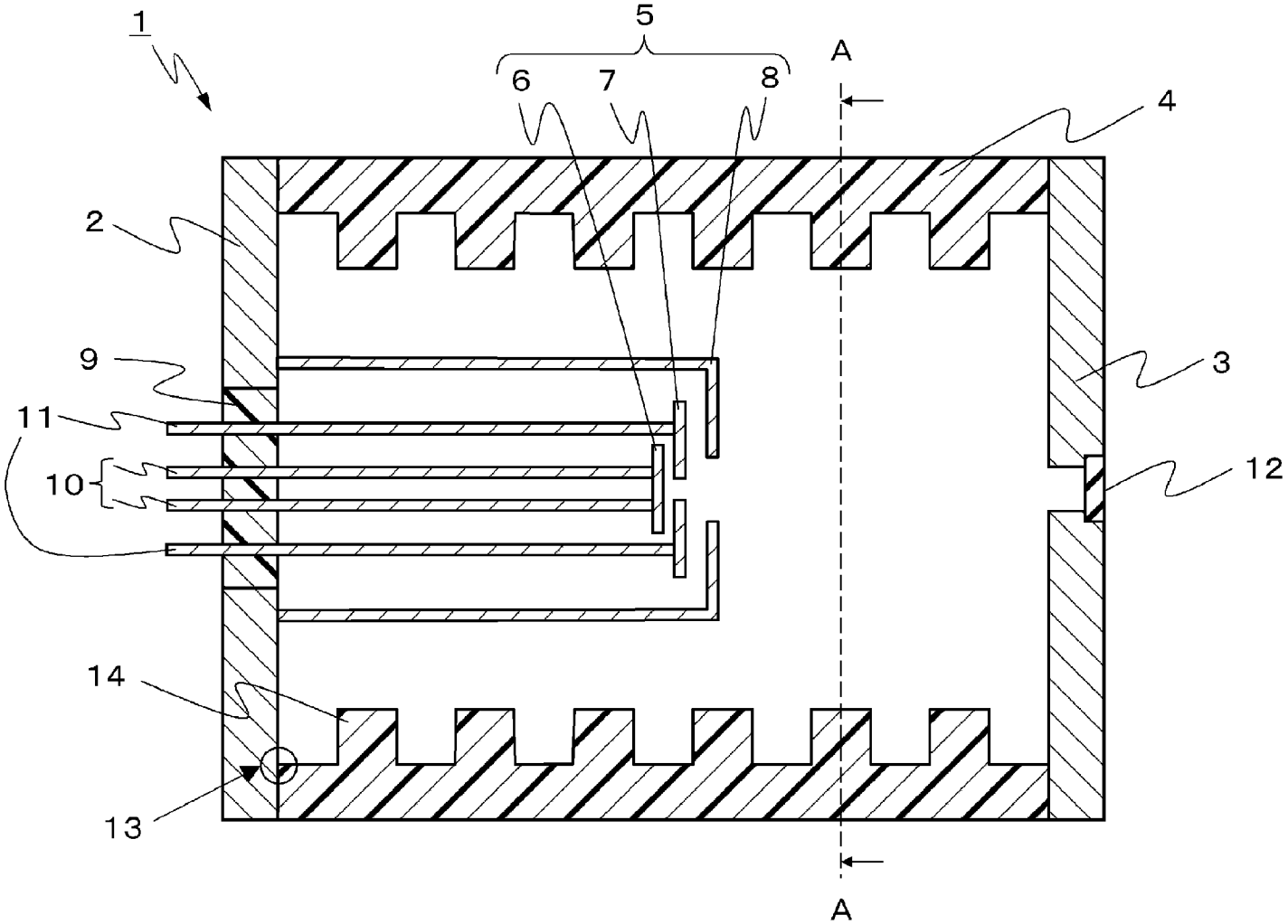
FIG. 1 is a sectional view schematically showing an example of a radiation generating tube according to the present invention.

A configuration of a transmissive radiation generating tube according to an embodiment of the present invention will now be described with reference to FIG. 1. FIG. 1 is an axial sectional view of a radiation generating tube cut along a plane that passes through a central axis of the radiation generating tube.

A radiation generating tube 1 comprises a cathode 2, an anode 3, and a hollow insulating tube (hereinafter referred to as an insulating tube) 4. The radiation generating tube is formed by respectively bonding the cathode 2 and the anode 3 to both end edges of the insulating tube 4 in an axial direction.

An electron emission source 5 comprising an electron emitting portion 6 is provided in an interior space of the radiation generating tube. The electron emission source 5 can be shaped so as to protrude in the axial direction from the cathode 2 toward the anode 3. The electron emission source 5 comprises the electron emitting portion 6, a grid electrode 7, an electron emitting portion driving terminal 10, and a grid electrode terminal 11, and is capable of controlling an amount of an electron emission current and an electron emission period of electrons emitted from the electron emission source 5 using an external circuit (not shown). The electron emission source 5 can also comprise a focusing electrode 8.

The electron emitting portion 6 emits electrons. While both a cold cathode and a hot cathode can be used as an electron emitting element of the electron emitting portion 6, an impregnated cathode (hot cathode) that enables extraction of a large current in a stable manner is favorably used as an electron source that is applied to the radiation generating tube. When a heater in a vicinity of the electron emitting portion is energized, the impregnated cathode increases cathode temperature and emits electrons.

The grid electrode 7 is an electrode to which a predetermined voltage is applied to extract electrons emitted from the electron emitting portion 6 into a vacuum. The grid electrode 7 is arranged at a predetermined distance from the electron emitting portion 6. In addition, a shape, a bore diameter, a numerical aperture, and the like of the grid electrode 7 are determined in consideration of electron extraction efficiency and exhaust conductance in the vicinity of the cathode. For example, a tungsten mesh with a wire diameter of around 50 μm can be favorably used.

The focusing electrode 8 is an electrode arranged in order to control a spread (in other words, a beam diameter) of an electron beam extracted by the grid electrode 7. Normally, a beam diameter is adjusted by applying a voltage from several hundred V to several kV to the focusing electrode 8. Depending on a structure of a vicinity of the electron emitting portion 6 and an applied voltage, the focusing electrode 8 may be omitted and an electron beam may be focused solely by a lens effect of an electric field.

The cathode 2 comprises an insulating member 9. The electron emitting portion driving terminal 10 and the grid electrode terminal 11 are fixed to the insulating member 9 so as to be electrically insulated from the cathode 2. Both terminals 10 and 11 are extracted to the outside of the radiation generating tube 1 from the electron emitting portion 6 and the grid electrode 7 inside the radiation generating tube 1. Meanwhile, the focusing electrode 8 is directly fixed to the cathode 2 and is regulated to a same potential as the cathode 2. However, alternatively, the focusing electrode 8 may be insulated from the cathode 2 and given a different potential from the cathode 2. A voltage that causes electrons that have been emitted from the electron emitting portion 6 to be efficiently irradiated on a target 12 is appropriately selected.

The anode 3 comprises the target 12 that generates radiation when collided by an electron beam having predetermined energy. A voltage of around several ten to a hundred kV is applied to the anode 3. An electron beam generated by the electron emitting portion 6 and extracted by the grid electrode 7 is directed toward the target 12 on the anode 3 by the focusing electrode 8, accelerated by the voltage applied to the anode 3, and collides with the target 12 to generate radiation. X-rays are also emitted in a direction of a surface opposite to an electron beam colliding surface of the target 12 and extracted to the outside of the radiation generating tube 1.

The target 12 has a structure in which a metallic film that generates radiation when collided by electrons is attached to an electron beam irradiating surface of a substrate that transmits radiation. Normally, a material having an atomic number of 26 or higher can be used as the metallic film. Specifically, a thin film using tungsten, molybdenum, chromium, copper, cobalt, iron, rhodium, rhenium, and the like or an alloy material thereof can be favorably used so as to form a dense film structure by physical deposition such as sputtering. While an optimum value of a film thickness of the metallic film differs since an electron beam penetration depth or, in other words, an X-ray generation area differs depending on accelerating voltage, the metallic film normally has a thickness of around several to several ten μm when using an accelerating voltage of around hundred kV. Meanwhile, the substrate must be highly radiation-transmissive and highly thermally conductive, and capable of withstanding vacuum lock, and diamond, silicon nitride, silicon carbide, aluminum carbide, aluminum nitride, graphite, beryllium and the like can be favorably used. More favorably, diamond, aluminum nitride, or silicon nitride which are highly radiation-transmissive and more thermally conductive than tungsten is desirable. A thickness of the substrate need only satisfy the functions described above, and while thicknesses differ among materials, a thickness between 0.1 mm and 2 mm is favorable. In particular, diamond surpasses other materials in terms of an extremely high thermal conductivity, a high radiation transmission, and an ability of vacuum retention.

Besides thermal bonding, the bonding between the target 12 and the anode 3 is favorably performed by brazing or welding in consideration of maintaining a vacuum.

The insulating tube 4 is formed of an insulating material such as glass or ceramics. The cathode 2 and the anode 3 are respectively bonded to end edges (open ends) on both sides of the insulating tube 4 by brazing or welding. When heating discharge is performed in order to improve the degree of vacuum in the radiation generating tube 1, materials with similar coefficients of thermal expansion are favorably used for the cathode 2, the anode 3, the insulating tube 4, and the insulating member 9. For example, favorably, kovar or tungsten is used as the cathode 2 and the anode 3 and borosilicate glass or alumina is used as the insulating tube 4 and the insulating member 9.

There are no constraints on the shape of the insulating tube 4 as long as the insulating tube 4 is a hollow tube and an air-tight bonding can be formed between the cathode 2 and the anode 3 so that an interior space becomes a vacuum. Although a cylinder is favorable in terms of downsizing and ease of fabrication, a cross-sectional shape of the insulating tube 4 is not limited to a circle and may be a shape such as an ellipse or a polygon. Alternatively, a cross-sectional area (a size of the internal space) or a cross-sectional shape of the insulating tube 4 may vary in an axial direction.

As described above, with a structure in which the cathode 2 is bonded to an end edge of the insulating tube 4, there is a risk that electron emission from the junction (bonded interface) 13 between the insulating tube 4 and the cathode 2 may electrically charge an inner wall of the insulating tube 4 and, consequently, may cause a discharge. In consideration thereof, in the present embodiment, a protrusion (an electron shielding structure) that shields electrons emitted from the junction 13 and suppresses the emitted electrons from colliding with the inner wall of the insulating tube 4 is provided in the interior space of a vacuum tube. In the example shown in FIG. 1, the protrusion is realized by a protruded portion 14 formed on the inner wall (inner circumferential surface) of the insulating tube 4.

The protruded portion 14 is shaped so as to protrude further inward in a radial direction (in other words, toward the electron emission source) than the junction 13. From the perspective of preventing the inner wall of the insulating tube 4 from becoming electrically charged, even irregularities with a mean roughness of around several μm are effective. However, in order to shield electrons emitted from the junction 13, the protruded portion 14 desirably protrudes further inward in the radial direction than the junction 13 by 50 μm or more. Furthermore, in order to stabilize the shielding effect, the protruded portion 14 more favorably protrudes further inward in the radial direction than the junction 13 by 1 mm or more. Moreover, in the example of the present embodiment, since the junction 13 is at a same height (position in the radial direction) as the inner wall of the insulating tube 4, an amount of protrusion of the protruded portion 14 from the junction 13 may be considered equal to a height (an amount of protrusion from the inner wall) of the protruded portion 14 itself. However, when the junction 13 is formed at a different height from the inner wall of the insulating tube 4, the height of the protruded portion 14 itself must be designed with a difference in height of the junction 13 and the inner wall in mind. Since emitted electrons from the junction 13 are shielded by providing the insulating tube 4 with such a protruded portion 14, reentry of electrons to an inner circumferential surface on a higher potential side (anode side) of the insulating tube 4 is suppressed. As a result, electrical charging can be suppressed more efficiently.

Figure 2:
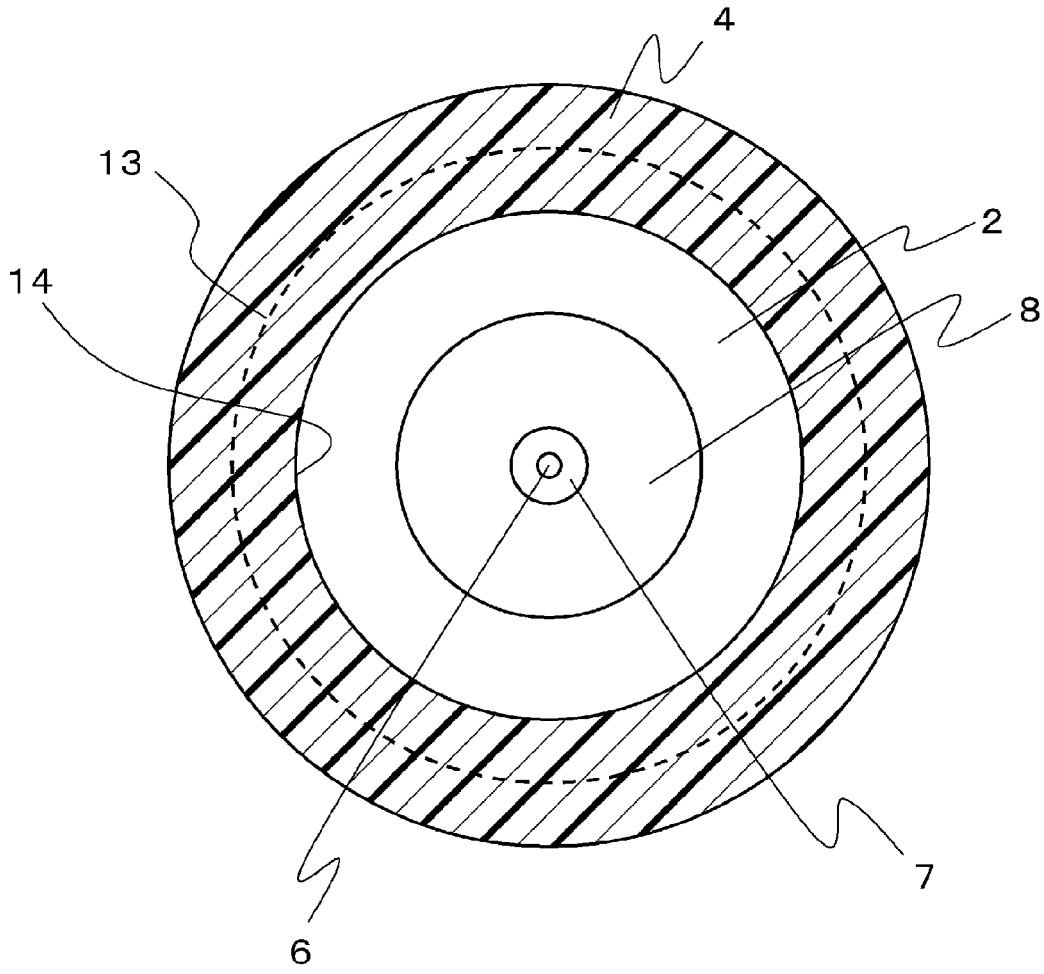
FIG. 2 is a sectional view schematically showing an example of a radiation generating tube according to the present invention.

A radial section of the radiation generating tube 1 sliced along a line A-A in FIG. 1 and in which the cathode side is viewed from the anode side is shown in FIG. 2. As shown in FIG. 2, when viewing the cathode side from the sliced portion, the junction 13 (depicted by a dotted line) is hidden from view by the protruded portion 14. The protruded portion 14 exists over the entire circumference of the inner wall of the insulating tube 4 and, accordingly, thoroughly shields emitted electrons from the junction 13 over the entire circumference.

For the purpose of shielding emitted electrons from the junction 13, simply providing at least one protruded portion 14 (protrusion) in a vicinity of the junction 13 may suffice. However, besides the junction 13 between the insulating tube 4 and the cathode 2, unintended electron emission may also occur from a foreign object having penetrated into the interior of the radiation generating tube or from a burr of an internal structure or the like. Such an electron emission is conceivably mainly generated by an adhered substance or a burr of the electron emission source 5. Therefore, instead of just providing the protruded portion 14 in the vicinity of the junction 13, a plurality of protruded portions 14 are favorably provided at different locations in the axial direction.

Figure 3A:
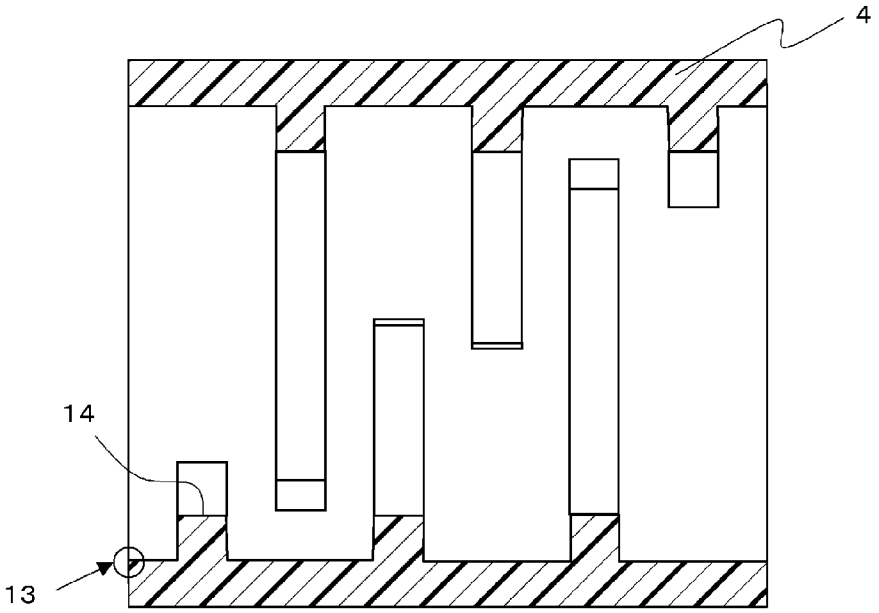
FIGS. 3A and 3B are sectional views schematically showing examples of an insulating tube of a radiation generating tube according to the present invention.
Figure 3B:
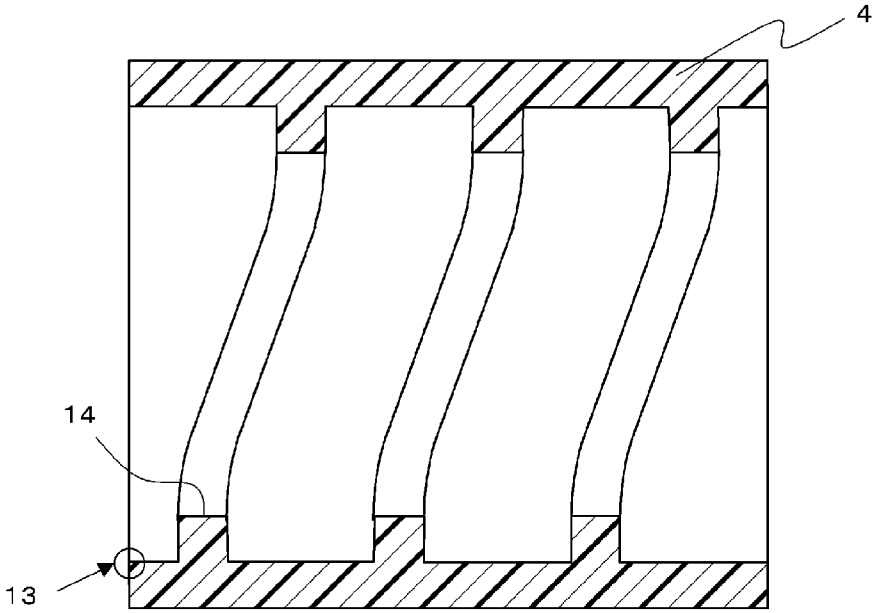
Figure 4:
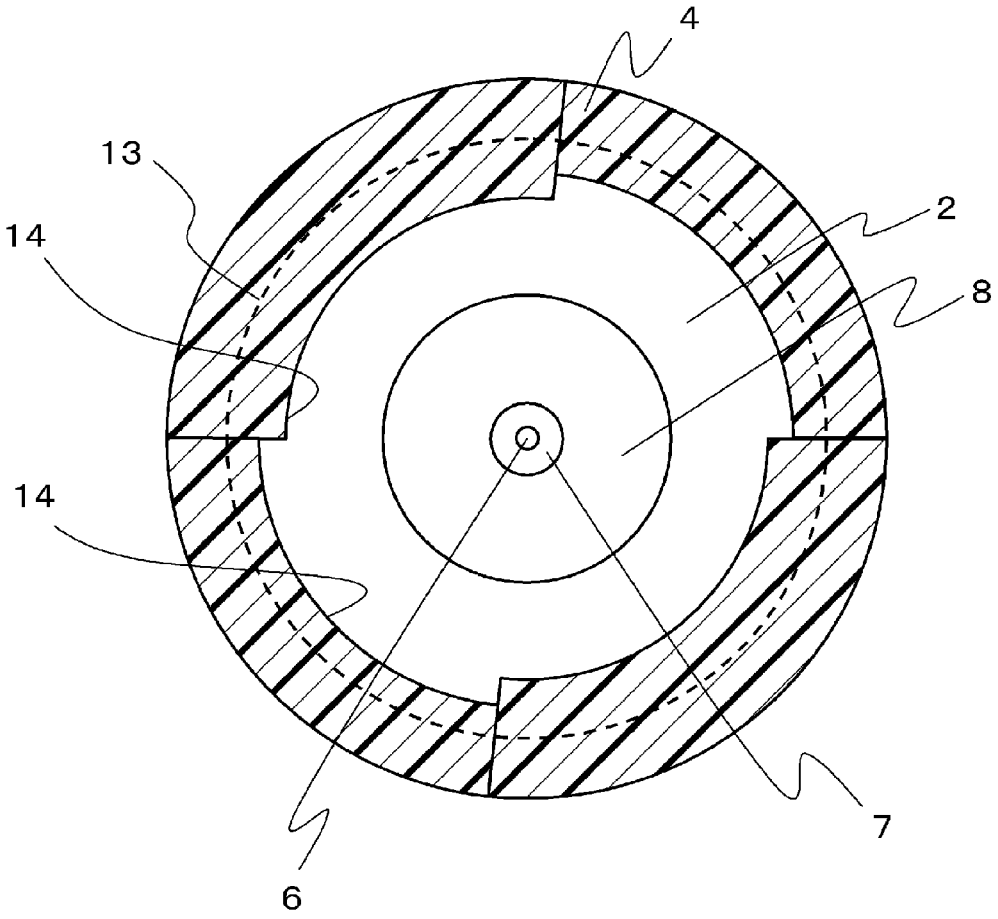
FIG. 4 is a sectional view schematically showing an example of a radiation generating tube according to the present invention.

Various patterns are conceivable for a mode in which a plurality of protruded portions 14 are provided. For example, as shown in FIGS. 1 and 2, a plurality of annular protruded portions may be arranged at predetermined intervals in the axial direction (FIGS. 1 and 2 show an example in which six annular shaped protruded portions are arranged at regular intervals and positioned so that a central axis thereof is coincide with that of the insulating tube 4.). In addition, as shown in FIG. 3A, a stepped (labyrinth-like) pattern may be formed by arranging a plurality of arc-shaped (non-annular) protruded portions at predetermined intervals in the axial direction while staggering circumferential positions thereof. Furthermore, as shown in FIG. 3B, a protruded portion 14 may be helically provided along the inner wall of the insulating tube 4. Moreover, the patterns shown in FIGS. 1 to 3 may be combined. Furthermore, all of the protruded portions need not necessarily have the same amount of protrusion, and the protruded portions 14 may include steps as shown in a radial section taken at an arbitrary location in FIG. 4. Due to the plurality of protruded portions, voltage withstand capability of the radiation generating tube 1 is increased and downsizing can be achieved.

On the other hand, increasing the amount of protrusion of the protruded portion 14 without restraint shortens a spatial distance to the electron emission source (in the present embodiment, the focusing electrode 8). As a result, depending on a potential difference between the electron emission source 5 and the protruded portion 14, there is a risk that spatial voltage withstand capability may deteriorate. A potential of the protruded portion 14 is an intermediate potential between a cathode potential and an anode potential which varies depending on a position of the protruded portion 14 in an axial direction, and the closer to the anode 3, the higher the potential of the protruded portion 14. Therefore, it is apparent that voltage withstand capability between the electron emission source 5 and the protruded portion 14 becomes most problematic in a vicinity of a tip of the electron emission source 5. In consideration thereof, a distance in the radial direction (or a distance of closest approach) from the electron emission source 5 of the protruded portion 14 provided close to the tip of the electron emission source 5 should be increased compared to the protruded portion 14 provided close to the cathode 2. Accordingly, a deterioration of spatial voltage withstand capability can be reduced.

Figure 5:
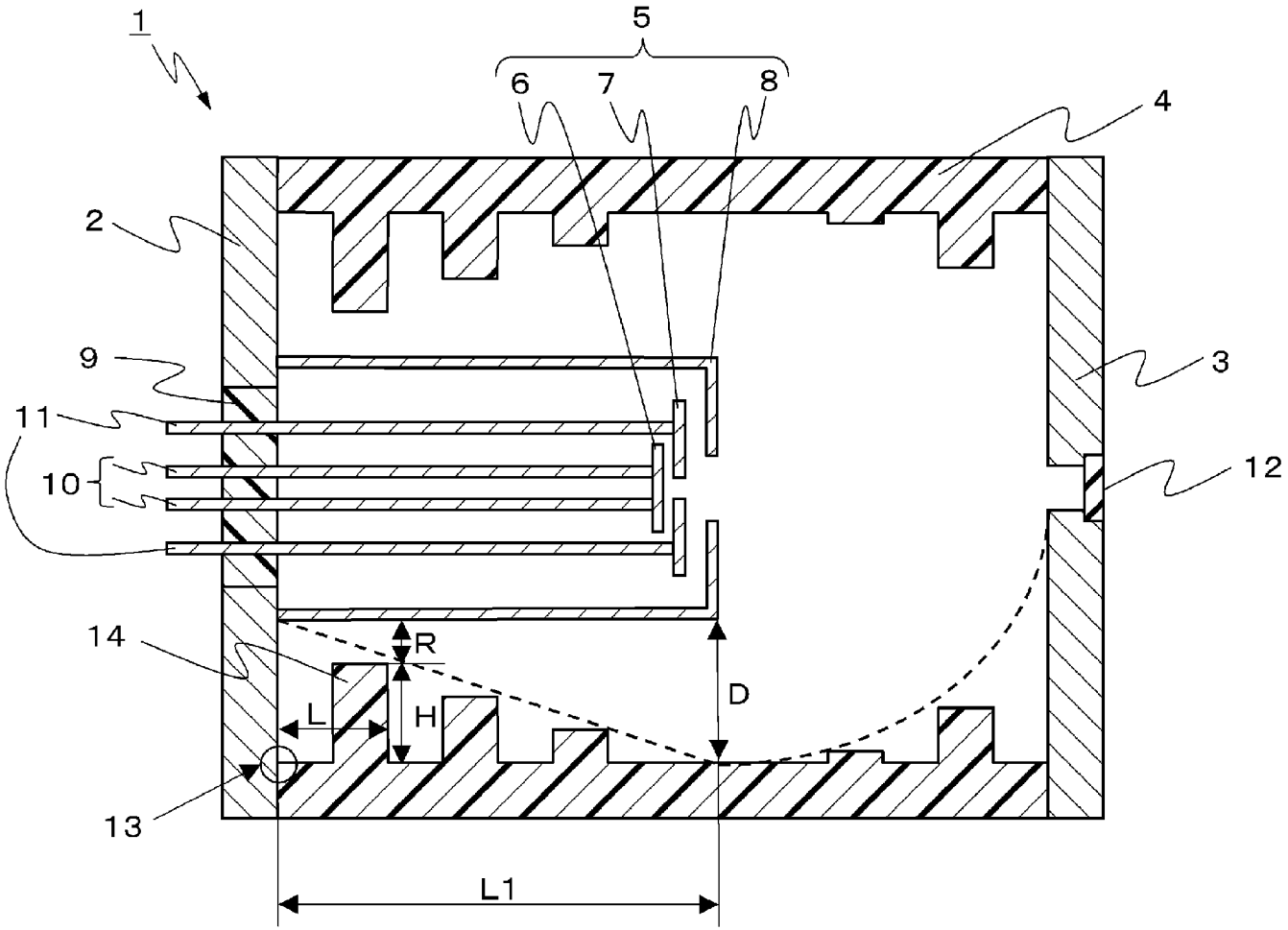
FIG. 5 is a sectional view schematically showing an example of a radiation generating tube according to the present invention.

An upper limit of the amount of protrusion of the protruded portion 14 will be further discussed in detail with reference to FIG. 5. FIG. 5 is an axial sectional view of a radiation generating tube cut along a plane that passes through a central axis of the radiation generating tube. The same reference characters as in FIG. 1 are used.

In FIG. 5, L1 denotes a distance between the cathode 2 and the tip of the electron emission source 5 in the axial direction, and D denotes a distance between the electron emission source 5 and the inner wall of the insulating tube 4 in the radial direction at the tip of the electron emission source 5 (in other words, a position at the distance L1 from the cathode 2). At this point, a distance of closest approach R (L) between the protruded portion 14 positioned at a distance L from the cathode 2 in the axial direction and the electron emission source 5 desirably satisfies a relationship expressed by Expression 1. In FIG. 5, an image of a boundary derived by Expression 1 is depicted by a dotted line. Expression 1 signifies that the protruded portion 14 does not cross the dotted line to the side of the electron emission source 5.

$$R(L) \geq D \times L/L1 \quad \text{(Expression 1)}$$

This is based on the condition that a field intensity of a space between the electron emission source 5 and the insulating tube 4 becomes maximum in a vicinity of a tip portion of the electron emission source 5. By satisfying Expression 1, both an increase in voltage and downsizing of the radiation generating tube can be realized without a decrease in voltage withstand capability due to a spatial field intensity between the electron emission source 5 and the protruded portion provided in the insulating tube 4.

When the inner wall of the insulating tube 4 is formed of a cylindrical surface as shown in FIG. 5, conditions to be satisfied by an amount of protrusion H (L) of the protruded portion 14 from the inner wall (in other words, a height of the protruded portion 14 from the inner wall) at a position with a distance L from the cathode 2 in the axial direction are as follows. Cases can be classified with reference to the tip (L=L1) of the electron emission source 5, whereby a cathode side thereof is expressed by Expression 2 and an anode side thereof is expressed by Expression 3.

where L≤L1:

$$H(L) \leq (1 - L/L1) \times D \quad \text{(Expression 2)}$$

where L>L1:

$$(D - H(L))^2 + (L - L1)^2 \geq (D \times L/L1)^2 \quad \text{(Expression 3)}$$

Moreover, as a shape of the insulating tube 4 according to the present invention, when a sectional area (a size of the internal space) or a sectional shape of the insulating tube 4 varies in the axial direction, H (L) may be considered as follows in consideration of an electrical field during an operation of the radiation generating tube. That is, using, as a reference plane, an virtual tubular inner wall surface that extends from the junction between the insulating tube 4 and the cathode 2 along a direction of an average electrical field generated in the space between the cathode 2 and the anode 3 during an operation of the radiation generating tube, by denoting a distance between an arbitrary position on the reference plane and the cathode 2 as L, the amount of protrusion H (L) of the protruded portion 14 from the virtual inner wall can be determined.

With the structure of the radiation generating tube according to the present embodiment described above, by providing the protruded portion 14 as the protrusion, since emitted electrons from the junction 13 between the cathode 2 and the insulating tube 4 and emitted electrons from a foreign substance, a burr, and the like can be shielded, electrical charging of the inner wall of the insulating tube 4 can be suppressed. Therefore, since the voltage withstand capability of the radiation generating tube 1 can be improved, a higher voltage and a smaller size of the radiation generating tube 1 can be readily achieved. The radiation generating tube 1 according to the present embodiment can be used in various radiation generating apparatuses.

Moreover, while a protrusion has been realized in the embodiment described above by the protruded portion 14 formed on the inner wall of the insulating tube 4, the structure of the protrusion is not limited thereto and any specific structure, shape, material, and the like may be adopted as long as emitted electrons from the junction 13 can be shielded. For example, the protrusion can be constituted by a circular or triangular protruded portion instead of the square protruded portion 14. Alternatively, the protrusion can be constituted by a different member (component) from the insulating tube 4.

In addition, although while the electron emission source 5 having the focusing electrode 8 has been shown in the embodiment described above, when the focusing electrode 8 is not provided, a distance of closest approach between other members (for example, the grid electrode 7) that constitute the electron emission source 5 and the protrusion need only be considered. Furthermore, there may be cases where the grid electrode 7 is not provided depending on the mode of the electron emitting portion 6, even in such a case, a distance of closest approach between other members that constitute the electron emission source 5 and the protrusion need only be considered.

First Example

Figure 6:
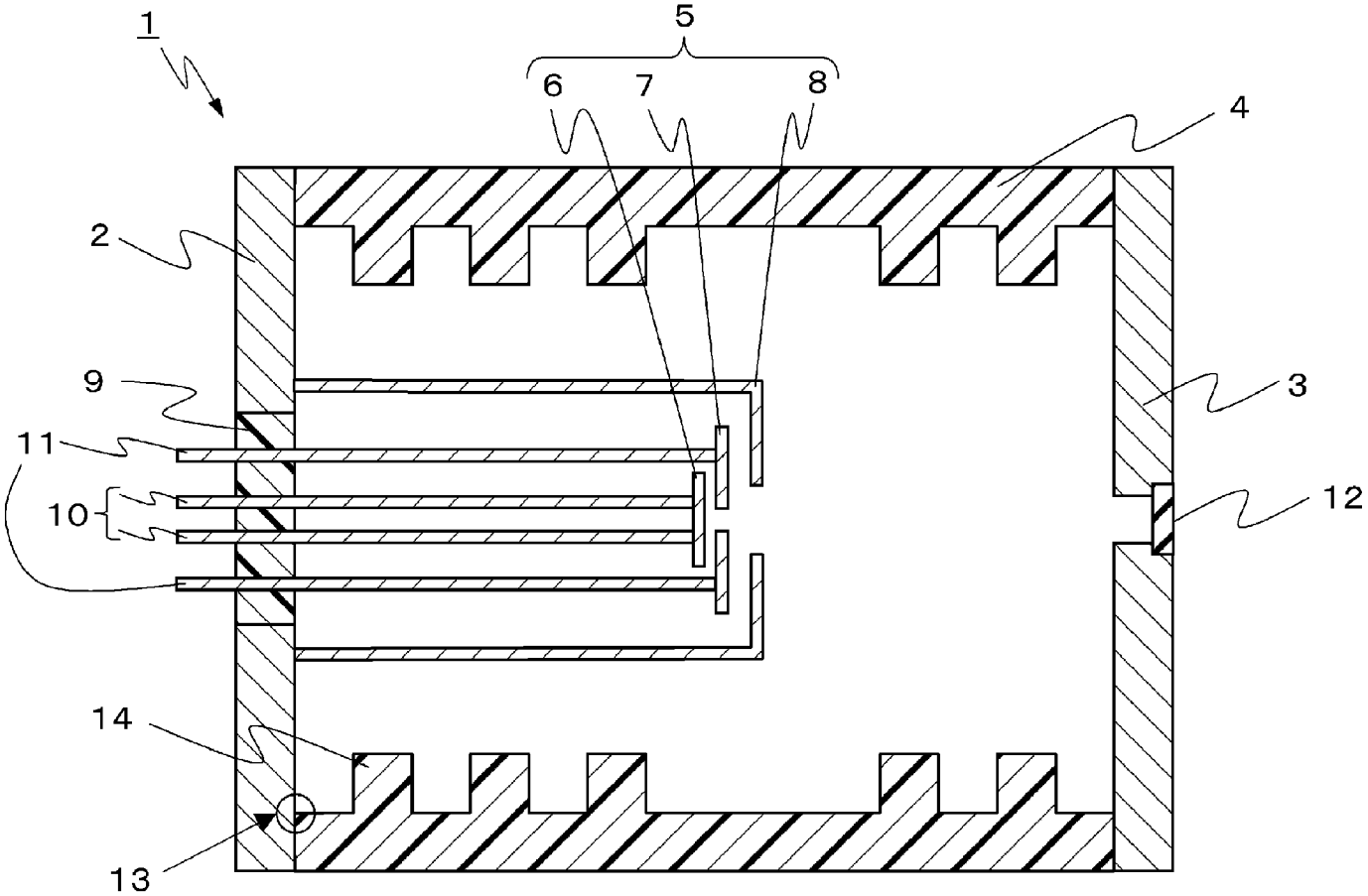
FIG. 6 is a sectional view schematically showing an example of a radiation generating tube according to the present invention.

A configuration of a radiation generating tube according to a first example will be described with reference to FIG. 6. FIG. 6 is an axial sectional view of a radiation generating tube cut along a plane that passes through a central axis of the radiation generating tube. A radiation generating tube 1 according to the present example comprises a cathode 2, an anode 3, an insulating tube 4, an electron emission source 5, an insulating member 9, an electron source driving terminal 10, a grid electrode terminal 11, and a target 12. Moreover, the electron emission source 5 comprises an electron emitting portion 6, a grid electrode 7, and a focusing electrode 8.

Kovar is used for the cathode 2 and the anode 3 and alumina is used for the insulating tube 4 and the insulating member 9. The cathode 2 and the anode 3 are bonded to the insulating tube 4 by welding. In particular, a junction between the cathode 2 and the insulating tube 4 inside the radiation generating tube is denoted by reference numeral 13.

An impregnated cathode manufactured by Tokyo Cathode Laboratory Co., Ltd. is used as the electron emitting portion 6. The cathode has a columnar shape impregnated with an emitter (an electron emitting portion) and is fixed to an upper end of a tubular sleeve. A heater is mounted inside the sleeve. When the heater is energized by the electron source driving terminal 10, the cathode is heated and thermions are emitted. The electron source driving terminal 10 is brazed to the insulating member 9.

The target 12 comprises a tungsten film with a film thickness of 5 μm formed on a silicon carbide substrate with a thickness of 0.5 mm. The target 12 is brazed to the anode 3.

The electron emission source 5 comprises the electron emitting portion 6, and the grid electrode 7 and the focusing electrode 8 arranged in sequence from the electron emitting portion 6 toward the target 12. The grid electrode 7 is energized from the grid electrode terminal 11 and efficiently extracts electrons from the electron emitting portion 6. The grid electrode terminal 11 is brazed to the insulating member 9 in a similar manner to the electron source driving terminal 10. The focusing electrode 8 is welded to the cathode 2 and is regulated to a same potential as the cathode 2. The focusing electrode 8 focuses a beam diameter of an electron beam extracted by the grid electrode 7 and irradiates the electron beam on the target 12 in an efficient manner.

The cathode 2, the anode 3, and the insulating tube 4 have an outer diameter of ϕ60 mm, the insulating tube 4 has an inner diameter of ϕ50 mm, and the focusing electrode 8 has an approximately columnar outer shape with an outer diameter of ϕ25 mm. Respective centers of the cathode 2, the anode 3, the insulating tube 4, and the focusing electrode 8 are aligned with each other. The insulating tube 4 has a length of 70 mm in an axial direction, and the focusing electrode 8 protrudes 40 mm beyond the cathode 2.

The insulating tube 4 comprises a protruded portion 14 inside the radiation generating tube. A total of five annular protruded portions 14 are provided, in which three protruded portions 14 with widths of 5 mm are provided at 5 mm-intervals from the cathode 2 and two protruded portions 14 with widths of 5 mm are provided at 5 mm-intervals from the anode 3. The five protruded portions 14 all have a height of 5 mm. In other words, all of the amounts of protrusion of the protruded portions 14 from the junction 13 are also 5 mm.

Finally, while applying heat, air is discharged from an exhaust tube (not shown) welded to the cathode 2 and the exhaust tube is sealed.

Five radiation generating tubes 1 were fabricated by the method described above and were subjected to a high voltage in insulating oil. With the cathode 2 grounded and the anode 3 connected to a high voltage power supply, an anode voltage was gradually increased. An average initially discharged voltage was 81 kV, and an average cumulative number of discharges until reaching 100 kV was 1.6. Without the protruded portions, the initial discharge voltage was 60 kV and the average cumulative number of discharges until reaching 100 kV was 5. Therefore, a high voltage withstand capability of the radiation generating tube according to the present example was demonstrated.

Second Example

The present example differs from the first example in that the height of the protruded portions were altered at some locations. A schematic diagram of the present example is shown in FIG. 5.

A total of five protruded portions 14 are provided, in which three protruded portions 14 with widths of 5 mm are provided at 5 mm-intervals from the cathode 2 and two protruded portions 14 with widths of 5 mm are provided at 5 mm-intervals from the anode 3. The five protruded portions 14 have, in an order of proximity from the cathode 2, respective heights H of 9 mm, 6 mm, 3 mm, 0.4 mm, and 5 mm.

Each protruded portion 14 is designed so that Expression 2 or 3 is satisfied at a location where a field intensity between the protruded portion 14 and the electron emission source 5 is conceivably the highest. Specifically, for the three protruded portions 14 on the side of the cathode, anode-side edges of the protruded portions 14 that have a high potential are assumed to be the locations having the highest field intensity, and for the two protruded portions 14 on the side of the anode, cathode-side edges that are closest to the electron emission source 5 are assumed to be the locations having the highest field intensity. Distances L of the respective positions from the cathode 2 are 10 mm, 20 mm, 30 mm, 50 mm, and 60 mm. By applying Expression 2 to the three cathode-side protruded portions 14 and Expression 3 to the two anode-side protruded portions 14, since D=12.5 mm and L1=40 mm, in an order of proximity from the cathode 2, the following is true:

$$9 \leq 9.375 \quad \text{(Expression 2)}$$

$$6 \leq 6.25 \quad \text{(Expression 2)}$$

$$3 \leq 3.125 \quad \text{(Expression 2)}$$

$$246.41 \geq 244.14 \quad \text{(Expression 3)}$$

$$456.25 \geq 351.56 \quad \text{(Expression 3)}$$

Five of the radiation generating tubes 1 described above were fabricated, and subjected to a high voltage in insulating oil in a similar manner to the first example. With the cathode 2 grounded and the anode 3 connected to a high voltage power supply, an anode voltage was gradually increased. An average initially discharged voltage was 86 kV, and an average cumulative number of discharges until reaching 100 kV was 1.4. Thus, it was demonstrated that the voltage withstand capability of the present example is higher than that of the first example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-123459, filed on Jun. 1, 2011, which is hereby incorporated by reference herein in its entirety.

What is claimed is:

1. An X-ray generating tube comprising:

a hollow insulating tube having an inner wall;

a cathode and an anode respectively bonded to first and second ends of said insulating tube; and an electron emission source provided on said cathode, said X-ray generating tube having a vacuum interior space that is enclosed by said insulating tube, said cathode, and said anode, wherein said electron emission source includes an electron emitting portion in said interior space and has a tip, and said insulating tube includes a protrusion that protrudes into said interior space, wherein when a distance in an axial direction from said cathode to said tip of said electron emission source is denoted by L1 and a distance in a radial direction between said electron emission source and said inner wall of said insulating tube at said tip of said electron emission source is denoted by D, a distance of closest approach R (L) between said electron emission source and said protrusion arranged at a position at a distance of L in the axial direction from said cathode satisfies the following relationship:

$$R(L) \geq D \times L/L1, \text{ and}$$

wherein said inner wall of said insulating tube is formed of a cylindrical surface, said protrusion is a protruding portion that protrudes inward in the radial direction from said inner wall of said insulating tube, and an amount of protrusion H (L) of said protruding portion from said inner wall satisfies the following relationships:

where L≤L1:

$$H(L) \leq (1 - L/L1) \times D, \text{ and}$$

where L>L1:

$$(D - H(L))^2 + (L - L1)^2 \geq (D \times L/L1)^2.$$

2. The X-ray generating tube according to claim 1, wherein said electron emission source is arranged so as to protrude from said cathode toward the side of said anode.

3. The X-ray generating tube according to claim 1, wherein said protrusion protrudes further inward in a radial direction than a junction between said insulating tube and said cathode by 50 μm or more.

4. The X-ray generating tube according to claim 3, wherein said protrusion protrudes further inward in the radial direction than said junction by 1 mm or more.

5. The X-ray generating tube according to claim 3, wherein said junction between said insulating tube and said cathode is hidden by said protrusion as viewed from said anode.

6. The X-ray generating tube according to claim 1, wherein said protrusion has an annular shape having a central axis that coincides with that of said insulating tube.

7. The X-ray generating tube according to claim 1, wherein said protrusion is provided over an entire circumference of said inner wall of said insulating tube.

8. The X-ray generating tube according to claim 1, wherein a plurality of protrusions are arranged at positions at different distances from said cathode in an axial direction.

9. The X-ray generating tube according to claim 8, wherein a distance in a radial direction between said electron emission source and said protrusion provided on a side closer to said tip of said electron emission source is greater than a distance in the radial direction between said electron emission source and said protrusion provided on a side closer to said cathode.

10. The X-ray generating tube according to claim 1, wherein said protrusion is helically positioned along said inner wall of said insulating tube.

11. An X-ray generating tube comprising:

a hollow insulating tube having an inner wall;

a cathode and an anode respectively bonded to first and second ends of said insulating tube; and an electron emission source provided on said cathode, the X-ray generating tube having a vacuum interior space that is enclosed by said insulating tube, said cathode, and said anode, wherein said electron emission source includes an electron emitting portion in said interior space and has a tip, and said insulating tube includes a protrusion that protrudes into said interior space further inward in a radial direction of said insulating tube than a junction between said insulating tube and said cathode, wherein said junction between said insulating tube and said cathode is hidden by said protrusion as viewed from said anode, and wherein said inner wall of said insulating tube is formed of a cylindrical surface, said protrusion is a protruding portion that protrudes inward in the radial direction from said inner wall of said insulating tube, and an amount of protrusion H (L) of said protruding portion from said inner wall satisfies the following relationship:

where L≤L1:

$$H(L) \leq (1 - L/L1) \times D$$

where L>L1:

$$(D - H(L))^2 + (L - L1)^2 \geq (D \times L/L1)^2, \text{ where}$$

L1 is a distance in an axial direction from said cathode to said tip of said electron emission source, D is a distance in a radial direction between said electron emission source and said inner wall of said insulating tube at said tip of said electron emission source, and L is a distance in the axial direction from said cathode.

* * * * *